US005682818A

United States Patent [19]

Braun et al.

[11] Patent Number: 5,682,818

[45] Date of Patent: Nov. 4, 1997

[54] ARRANGEMENT FOR AND METHOD OF REGULATING A PRINTING ROLLER

[75] Inventors: Paul-Wilhelm Braun, Troisdorf; Herbert Lehmann, Berlin, both of Germany

[73] Assignee: Ruhlatec Industrieprodukte GmbH, Seebach, Germany

[21] Appl. No.: 501,181

[22] Filed: Jul. 11, 1995

[30] Foreign Application Priority Data

Aug. 5, 1994 [DE] Germany ..... 44 27 733.4

[51] Int. Cl.[6] ..... B41F 13/24

[52] U.S. Cl. ..... 101/248; 101/216

[58] Field of Search ..... 101/216, 248, 101/212, 213, 217, DIG. 36

[56] References Cited

U.S. PATENT DOCUMENTS

| | | | |
|---|---|---|---|
| 3,476,043 | 11/1969 | Ryswick | 101/216 |
| 4,236,448 | 12/1980 | Wieland | 101/216 |
| 4,530,613 | 7/1985 | Horman et al. | 400/708 |
| 5,127,324 | 7/1992 | Palmatier et al. | 101/248 |
| 5,142,981 | 9/1992 | Dettinger et al. | 101/248 |

FOREIGN PATENT DOCUMENTS

| | | |
|---|---|---|
| 2 300 421 | 7/1974 | Germany . |
| 26 58 947 | 7/1978 | Germany . |
| 4-193563 | 7/1992 | Japan . |

OTHER PUBLICATIONS

Patent Abstract of Japan vol. 009, No. 313 (M–437), 10 Dec. 1985 & JP–A–60–147365 (Fuji Xerox KK), 3 Aug. 1985.

Patent Abstract of Japan vol. 009, No. 300 (M–433), 27 Nov. 1985 & JP–A–60–137757 (Toshiba KK), 22 Jul. 1985.

Translation of German claim 1 of DE 2 300 421.

*Rigid Foam Platen*, G.A. Duggins, D.D. Hendren, IBM Technical Disclosure Bulletin, vol. 17, No. 4, p. 115, Sep. 1974.

Patent Abstracts of Japan, M–1331 Oct. 27, 1992, vol. 16/No. 523.

*Primary Examiner*—Christopher A. Bennett

*Attorney, Agent, or Firm*—Darby & Darby

[57] ABSTRACT

A drive for a printer includes a printing roller which is driven by a step motor located at one axial end of the roller. A monitoring unit for the printing roller is disposed at the other axial end of the roller and comprises a belt which is mounted on two guide rollers. The rotational axes of the guide rollers are parallel to the rotational axis of the printing roller. The outer surface of the belt frictionally engages a portion of the peripheral surface of the printing roller so that the belt moves in response to rotation of the printing roller. One of the guide rollers for the belt drives a synchronizing disc having indicating elements which are sensed by a detector. The detector generates a synchronizing signal whenever an indicating element is detected, and the synchronizing signals are sent to a control unit. The control unit compares the synchronizing signals with reference signals and sends control signals to the motor when the synchronizing signals deviate from the reference signals.

19 Claims, 1 Drawing Sheet

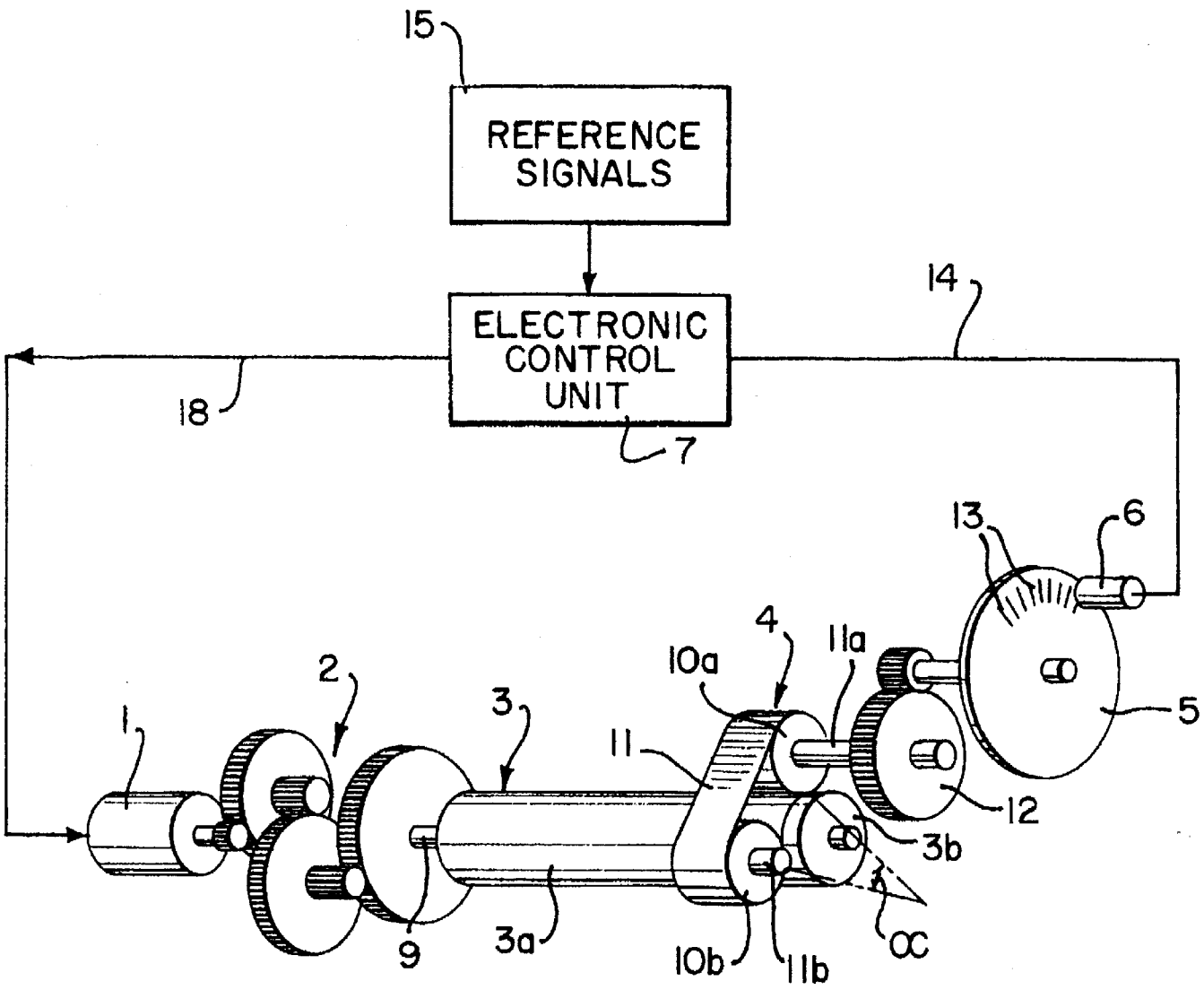
REFERENCE SIGNALS
ELECTRONIC CONTROL UNIT
15
7
14
18
6
5
13
12
3b
α
11a
11b
4
10a
10b
11
3
3a
9
2
1

ARRANGEMENT FOR AND METHOD OF REGULATING A PRINTING ROLLER

BACKGROUND OF THE INVENTION

The invention relates generally to printing.

A known arrangement for regulating a printing roller, i.e., a guide roller for the paper in a printer, includes an electronically controlled motor which is coupled to the printing roller by way of a gear mechanism. A friction drive connects the printing roller to a synchronizing disc, and the position of the synchronizing disc is sensed by a detector. When the position of the synchronizing disc deviates from a reference position by a predetermined amount, a correction signal is sent to the motor.

An arrangement of this type is disclosed in Patent Abstracts of Japan M-331 and the corresponding Japanese publication 4-193 163. Here, a printing roller drives a reference roller in such a manner that the peripheral speed of the reference roller equals the speed of the paper passing over the printing roller. The movement of the reference roller is sensed by a detector, and the detector generates control signals for a motor which drives the printing roller.

The preceding arrangement is intended to improve the accuracy of the paper feed by decreasing the effects of temperature. Greater accuracy is achieved by using a hard material for the reference roller.

To precisely determine the peripheral speed of the printing roller, the reference roller must be pressed against the paper which passes over the printing roller. Such pressing of the reference roller has drawbacks, particularly for soft paper, because the hard reference roller is impressed in the paper. This results not only in measurement errors but also in unsightly lines on the paper which adversely affect the printed product.

SUMMARY OF THE INVENTION

It is an object of the invention to provide an arrangement which enables more accurate measurement of the rotation of a rotary member to be achieved.

Another object of the invention is to provide an arrangement which allows a rotary member to more precisely position an article guided by the rotary member.

An additional object of the invention is to provide a method which makes it possible to measure the rotation of a rotary member with higher accuracy.

A further object of the invention is to provide a method which permits a rotary member to position an article with increased precision.

The preceding objects, as well as others which will become apparent as the description proceeds, are achieved by the invention.

One aspect of the invention resides in a drive which comprises a rotary member, e.g., a printing roller, driving means for the rotary member, and regulating means for the driving means. The regulating means includes a pair of shafts, an endless flexible member mounted on the shafts for movement in an endless path, means for monitoring movement of the flexible member, and means responsive to the monitoring means for sending control signals to the driving means. The flexible member frictionally engages the rotary member in a portion of the endless path.

The use of an endless flexible member which is guided by two shafts makes it possible to reduce the pressing force which is exerted on the rotary member for monitoring purposes. Furthermore, the frictional force between the rotary member and the flexible monitoring member can be adjusted by increasing or decreasing the contact area of the rotary member and the flexible member.

Another aspect of the invention resides in a method of regulating a rotary member, e.g., a printing roller, having a peripheral surface. The method comprises the steps of moving a monitoring member along a predetermined path, wrapping successive increments of the monitoring member around a portion of the peripheral surface of the rotary member, monitoring movement of the monitoring member, generating monitoring signals in response to the monitoring step, and controlling the rotary member on the basis of the monitoring signals.

The method may further comprise the step of comparing the monitoring signals with reference signals. The controlling step then includes producing control signals when the monitoring signals and the reference signals deviate from one another by a predetermined magnitude.

Additional features and advantages of the invention will be forthcoming from the following detailed description of preferred embodiments when read in conjunction with the accompanying drawing.

BRIEF DESCRIPTION OF THE DRAWING

The sole FIGURE schematically illustrates a drive in accordance with the invention.

DESCRIPTION OF THE PREFERRED EMBODIMENTS

Referring to the FIGURE, a drive according to the invention is shown. The drive is here of the type used in printing presses and could, for example, find application in regulating the paper feed for a series of printers.

The drive includes a step motor 1 which is coupled to a printing roller or rotary member 3 by way of a multistage gear mechanism or transmission 2. The motor 1 drives the printing roller 3 in steps so that the roller 3 rotates line-by-line.

The roller 3, which is elongated and of cylindrical configuration, has a cylindrical external peripheral surface 3*a*. The roller 3 further has axial ends 3*b* and 3*c* which are respectively remote from and nearer to the motor 1. The end 3*c* of the roller 3 is connected to the gear mechanism 2 by way of a stub 9 which defines the axis of rotation of the roller 3. The axis of rotation is also the longitudinal axis of the roller 3.

A friction drive 4 is located at the end 3*b* of the roller 3, namely, the end of the roller 3 remote from the motor 1. The friction drive 4 comprises a pair of spaced, parallel shafts 11*a* and 11*b* which support respective guide rollers 10*a* and 10*b* for rotation. The shafts 11*a*,11*b* extend in parallelism with the printing roller 3 and define rotational axes which are parallel to the axis of rotation of the roller 3.

The friction drive 4 further comprises a belt or endless flexible member 11 which is mounted on the guide rollers 10*a*,10*b*. The guide rollers 10*a*,10*b* guide the belt 11 for movement along a predetermined endless path including a section in which the belt 11 is wrapped around and frictionally engages a portion of the external peripheral surface 3*a* of the printing roller 3. The belt 11 contacts the roller 3 along an arc having a measure or angle alpha. The arrangement is preferably such that the outer surface of the belt 11, that is, the surface of the belt 11 which faces away from the shafts 11*a*, 11*b* and the rollers 10*a*, 10*b*, engages the roller 3.

The shaft 11*a* is coupled to a gear mechanism 12 which drives a synchronizing disc 5 in rotation. The synchronizing disc 5 is provided with indicating or synchronizing elements 13, e.g., marks, and a detector or sensor 6 senses the indicating elements 13 as the synchronizing disc 5 rotates and generates synchronizing or monitoring signals in response to detection of the indicating elements 13. The synchronizing signals are sent to an electronic control unit 7 by way of a conductor 14. The control unit 7 includes a source of reference signals 15, and the control unit 7 compares the synchronizing signals with the reference signals. If the synchronizing signals deviate from the reference signals by a magnitude equal to or greater than a predetermined magnitude, the control unit 7 generates correction or control signals. The correction signals are transmitted to the motor 1 via a conductor 8.

The operation of the drive of the invention is as follows:

The motor 1 is started and rotates the printing roller 3 which, in turn, advances paper to be printed. The motor 1 moves the roller 3 in steps having a length which corresponds, for example, to a desired spacing between lines of printed matter.

Since the belt 11 is in frictional engagement with the roller 3, the belt 11 is driven by the roller 3 and moves along the endless path of travel defined by the rollers 3, 10*a*, 10*b*. As the belt 11 moves, successive increments of the belt 11 are wrapped around successive portions of the peripheral surface 3*a* of the roller 3. Each such portion extends along an arc of measure alpha.

The synchronizing disc 5 rotates in response to movement of the belt 11 along its path of travel inasmuch as the shaft 11*a* of the guide roller 10*a* for the belt 11 is coupled to the synchronizing disc 5 by way of the gear mechanism 12. As the synchronizing disc 5 rotates, the detector 6 senses the indicating elements 13 of the synchronizing disc 5. The detector 6 generates a synchronizing signal whenever an indicating element 13 is detected, and the synchronizing signals are sent to the control unit 7. The control unit 7 compares the synchronizing signals with the reference signals from the source 15.

As long as the synchronizing signals and the reference signals deviate from one another by less than a predetermined magnitude, the roller 3 and the paper being printed are properly synchronized and the control unit 7 allows the motor 1 to operate undisturbed. However, when the deviation between the synchronizing signals and the reference signals reaches the predetermined magnitude, the roller 3 and the paper no longer have the proper synchronism. The control unit 7 then sends one or more control signals to the motor 1 to adjust the motor 1 as necessary to once again achieve proper synchronization of the roller 3 and the paper.

Various modifications are possible within the meaning and range of equivalence of the appended claims.

What is claimed is:

1. A drive, comprising a rotary member; driving means for said rotary member; and regulating means for said driving means, said regulating means including a pair of shafts, an endless flexible member mounted on said shafts for movement in an endless path, means for monitoring movement of said flexible member, and means responsive to said monitoring means for sending control signals to said driving means, said flexible member frictionally engaging said rotary member in a section of said path.

2. The drive of claim 1, wherein said rotary member comprises a roller.

3. The drive of claim 2, wherein said roller comprises a printing roller.

4. The drive of claim 1, wherein said flexible member comprises a belt.

5. The drive of claim 1, wherein said flexible member has a surface which faces away from said shafts and said surface engages said rotary member.

6. The drive of claim 1, wherein said section of said path defines an arc.

7. The drive of claim 1, wherein said regulating means further includes means coupling said monitoring means to one of said shafts.

8. The drive of claim 1, wherein said responsive means is electronic.

9. The drive of claim 1, wherein said driving means comprises a motor, and gear means coupling said motor to said rotary member.

10. The drive of claim 1, wherein said monitoring means comprises a synchronizing disc provided with indicating elements, and a detector for sensing said indicating elements.

11. The drive of claim 1, wherein said monitoring means comprises means for generating monitoring signals and said responsive means comprises a source of reference signals, said responsive means being designed to compare said monitoring signals with said reference signals and to send control signals to said driving means when said monitoring signals and said reference signals deviate from one another by a predetermined magnitude.

12. The drive of claim 1, wherein said rotary member has a longitudinal axis, a first axial end remote from said driving means, and a second axial end between said first axial end and said driving means, said flexible member being located in the region of said first axial end.

13. The drive of claim 7, wherein said coupling means comprises gear means.

14. A method of regulating a rotary member having a peripheral surface, comprising the steps of moving a monitoring member along a predetermined path; wrapping successive increments of said monitoring member around a portion of said peripheral surface; monitoring movement of said monitoring member; generating monitoring signals in response to the monitoring step; and controlling said rotary member on the basis of said monitoring signals.

15. The method of claim 14, further comprising the step of comparing said monitoring signals with reference signals; and wherein the controlling step comprises producing control signals when said monitoring signals and said reference signals differ by a predetermined magnitude.

16. The method of claim 14, wherein said rotary member comprises a roller.

17. The method of claim 16, wherein said roller comprises a printing roller.

18. A drive, comprising a printing roller; driving means for said roller including a motor and gear means coupling said motor to said roller; and regulating means for said driving means, said regulating means including a pair of shafts, a belt mounted on said shafts for movement in an endless path having an arcuate section, means for monitoring movement of said belt, gear means coupling said monitoring means to one of said shafts, and electronic means responsive to said monitoring means for sending control signals to said driving means, said belt having a surface which faces away from said shafts, and said surface frictionally engaging said roller in said arcuate section of said path, said monitoring means comprising a synchronizing disc provided with indicating elements, a detector for sensing said indicating elements, and means for generating monitoring signals, said responsive means including a source of reference signals, and said responsive means being designed to compare said monitoring signals with said reference signals and to send control signals to said driving means when said monitoring signals and said reference signals deviate from one another by a predetermined magnitude.

19. A method of regulating a printing roller having a peripheral surface, comprising the steps of moving a monitoring member along a predetermined path; wrapping successive increments of said monitoring member around a portion of said peripheral surface; monitoring movement of said monitoring member; generating monitoring signals in response to the monitoring step; comparing said monitoring signals with reference signals; and controlling said roller on the basis of said monitoring signals, the controlling step including producing control signals when said monitoring signals and said reference signals differ by a predetermined magnitude.

* * * * *